United States Patent [19]

Martin

[11] 4,036,392

[45] July 19, 1977

[54] DISPOSABLE BEVERAGE CONTAINER COVER ELEMENT CARRYING FOLDED DRINKING STRAW

[76] Inventor: Marvin C. Martin, 520 Peren Ave., Chesapeake, Va. 23320

[21] Appl. No.: 737,407

[22] Filed: Nov. 1, 1976

[51] Int. Cl.[2] ..... B65D 1/24; B65D 1/36; B65D 57/00

[52] U.S. Cl. ..... 220/23; 220/90.2; 220/85 D; 229/7 S; 215/1 A; 206/217

[58] Field of Search ..... 220/23, 90.2, 85 D; 229/7 S, 1.5 C; 215/1 A; 206/217

[56] References Cited

U.S. PATENT DOCUMENTS

| | | | |
|---|---|---|---|
| 3,623,632 | 11/1971 | Chang | 220/90.2 |
| 3,874,554 | 4/1975 | Chang | 220/90.2 |

*Primary Examiner*—George T. Hall
*Attorney, Agent, or Firm*—J. Maxwell Carson, Jr.

[57] ABSTRACT

A disposable cover element for a disposable beverage container having a recess centrally formed in the exterior surface thereof adapted to carry readily removably secured therein a foldable drinking straw. Such drinking straw includes two transversely corrugated lengths, the centers of which are spaced apart a distance substantially equal to one-half of the total length of such drinking straw, and which are each bendable into a half-loop configuration. Such drinking straw further includes a straight length extending between the two corrugated lengths thereof, as well as shorter terminal straight lengths. Such drinking straw is foldable until the opposite ends thereof are substantially in abutment, and the straight terminal lengths thereof are substantially in alignment, and the recess provided in such cover element is proportioned to receive such drinking straw in such folded condition; small projections or projecting portions provided adjacent the side walls of such recess serving to retain such folded drinking straw therein until manually removed therefrom. Such recess further includes an enlargement into which a fingertip may be inserted for facilitating the removal of such folded drinking straw therefrom. After removal from such cover element recess, such drinking straw is readily straightened for use.

7 Claims, 5 Drawing Figures

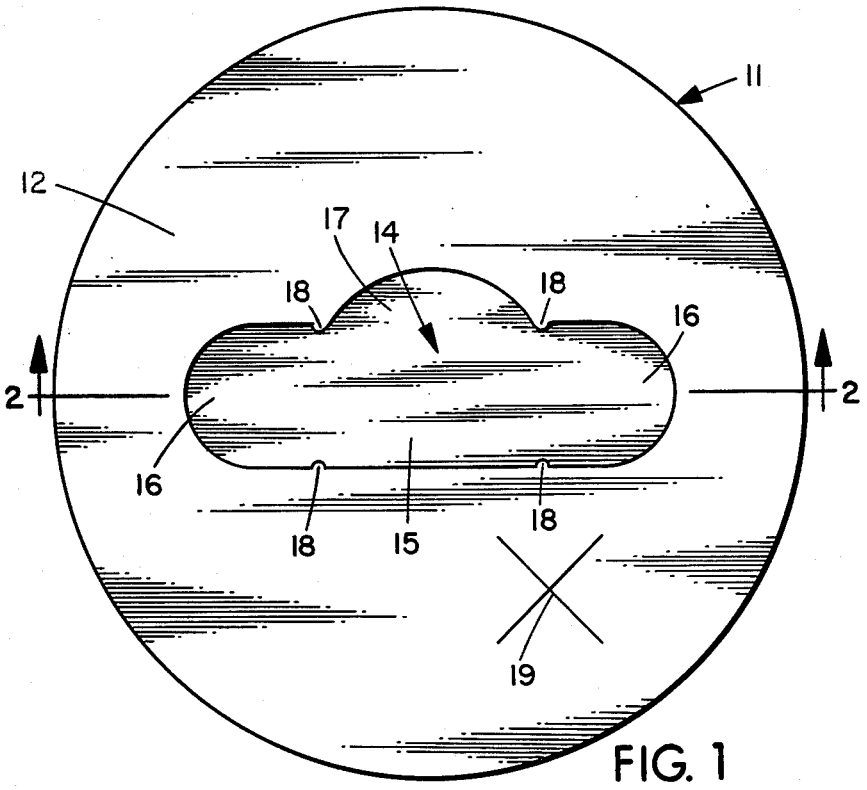
FIG. 1
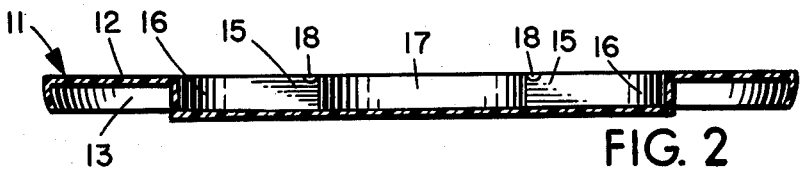
FIG. 2
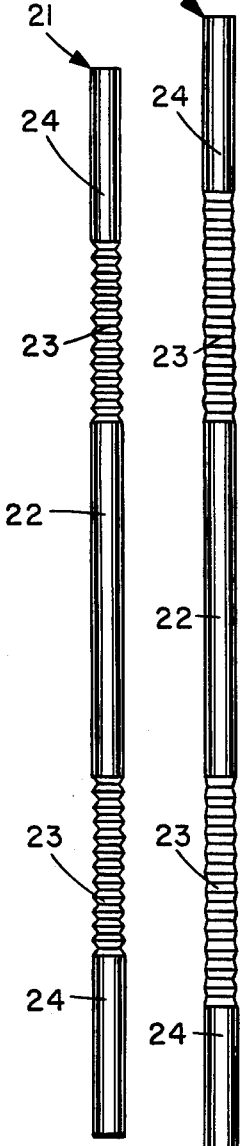
FIG. 3
FIG. 5
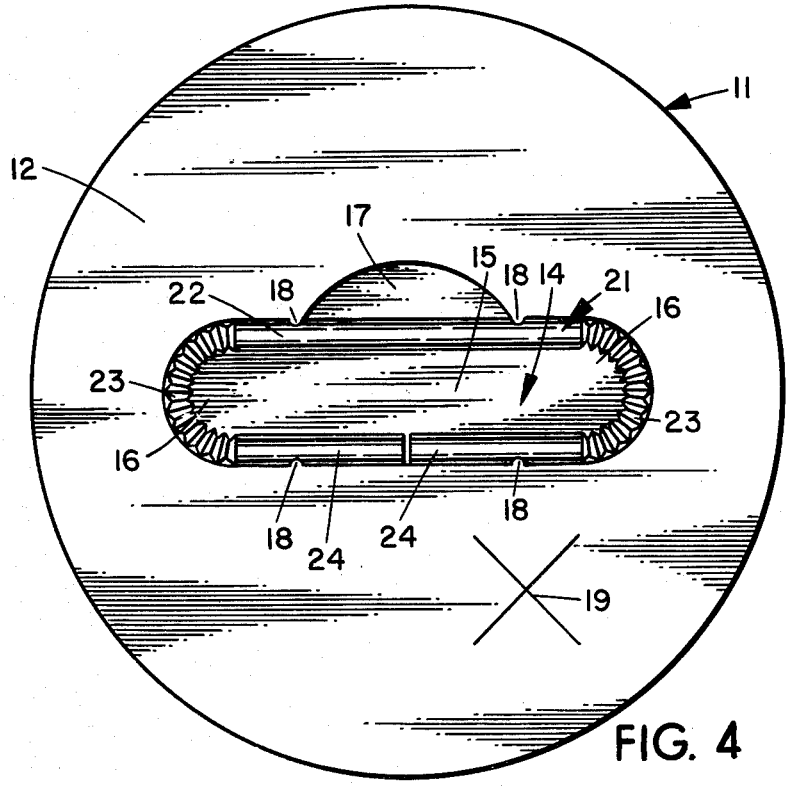
FIG. 4

DISPOSABLE BEVERAGE CONTAINER COVER ELEMENT CARRYING FOLDED DRINKING STRAW

This invention relates generally to a cover element for a beverage container, and more particularly to a disposable cover element for a disposable beverage container carrying readily removable therefrom a folded drinking straw.

In establishments where food and beverages are sold to consumers, and particularly in fast service food shops and the like, it is a customary practice to serve cold beverages such as the carbonated cola drinks in disposable containers closed by a disposable cover element. When such beverages are handed over to a consumer, usually across a counter, it is also customary to separately provide such a consumer with one or more drinking straws, which are usually individually enclosed in a casing element made of paper or the like in the interest of sanitation, and which are usually stored in quantity in a holder placed on such a counter within the reach of such consumer in order that he or she may extract therefrom the desired number of the same. A consumer then must remove each such straw from the casing element enclosing the same, usually remove the disposable cover element from the container holding his or her beverage, and then insert such straw or straws into such beverage before commencing to drink the same. In the operation of a food and beverage establishment as hereinbefore set forth, it will be apparent that holders for such straws will take up valuable counter space, that extra shipping space for such separately provided straws will have been utilized, and that extra storage space for such separately provided straws must have been set aside on the premises of such establishment prior to the placing of the same in such holders therefor; all of which materially contributes to the overhead costs of operating such an establishment.

The disposable cover element for a disposable beverage container carrying readily removable therefrom a folded drinking straw according to the instant invention is provided for the purpose of obviating certain of the problems heretofore encountered in the operation of a food and beverage establishment, as set forth hereinbefore. While, at this point, it is acknowledged that others have previously proposed the combination of a drinking straw with a bottle cap, as shown in U.S. Pat. No. 2,837,234 (215-229) granted to N. R. Mainiere on June 3, 1958, and in U.S. Pat. No. 2,844,267 (215-229) issued on July 22, 1958, to P. Petriccione; have further proposed the combination of a drinking straw with the closed upper ends of containers of other types, as disclosed in U.S. Pat. No. 2,547,362 (222-528) granted to R. W. Berry on Apr. 3, 1951; and have even proposed the construction of bottle caps including securing means externally mounted thereon adapted to receive certain articles, as shown in U.S. Pat. No. 1,721,185 (215-227) issued on July 16, 1929, to T. O. Meadors; it is nevertheless considered that the novel article disclosed in the present application provides advantages heretofore unattainable with the foregoing or other prior art devices, and is deemed to fill a need not heretofore satisfied by any prior art extant in the field of the invention disclosed herein.

Accordingly, an object of the instant invention is the provision of a disposable cover element for a beverage container provided with means for externally securing thereto a folded drinking straw readily detachable therefrom.

Another object of the present invention is the provision of a disposable cover element for a disposable beverage container having externally secured thereto a folded drinking straw readily removable therefrom.

According to the instant invention, the foregoing and other objects are obtained by providing a disposable cover element for a disposable beverage container having a recess centrally formed in the exterior surface thereof; such recess including an elongated central segment as well as a preferably arcuately shaped segment at each of the opposed ends of such central segment thereof. One of the sides of such elongated central segment of such recess further centrally includes an arcuate area constituting an enlargement of such recess sufficient to permit the introduction of a fingertip thereinto, and small projecting portions are disposed at about the plane of the exterior surface of such cover element to project into such recess over an appreciable portion of the depth thereof from each of the sides of such elongated central segment thereof. A drinking straw is insertable into such recess provided in such beverage container cover element; such drinking straw having straight sections disposable in such elongated central segment of such recess and having two transversely corrugated bendable sections each of which, when bent, is simultaneously disposable in preferably arcuately shaped end segment of such recess. When such straw has been disposed in such recess, such small projecting portions secure the same therein against inadvertent withdrawal, while yet allowing such straw to be readily manually extracted from such recess.

A more complete appreciation of the invention and many of the attendant advantages thereof will be readily apparent as the same becomes better understood by reference to the following detailed description when considered in connection with the accompanying drawing wherein:

FIG. 1 is a top plan view of the disposable cover element for a disposable beverage container according to the present invention;

FIG. 2 is a sectional, elevational view thereof, taken on the line 2—2 of FIG. 1;

FIG. 3 is a side elevational view of a foldable drinking straw insertable in the recess provided in the disposable cover element for a disposable beverage container according to the instant invention;

FIG. 4 is a top plan view of the disposable cover element for a disposable beverage container according to the present invention having such foldable drinking straw readily removably secured in such recess provided therein; and FIG. 5 is a side elevational view of such drinking straw showing the same after removal from such recess provided in such disposable cover element for such disposable beverage container and straightened and elongated for use.

Referring now more particularly to the drawing, wherein like reference numerals designate the same or identical parts throughout the several views, and more specifically to FIGS. 1 and 2, there is shown a disposable cover element, generally designated by the reference numeral 11, for a disposable beverage container. The cover element 11, which is preferably molded from a somewhat resilient plastic material, includes a circular section 12 adapted to overlie the circular upper opening of a conventional disposable beverage container, not illustrated, of the type having a rolled bead peripherally surrounding the outer surface thereof at the upper end thereof. The cover element 11 further includes a downwardly depending, substantially ring shaped, rim section 13 peripherally integrally interconnected with the circular section 12 thereof; such rim section 13 having an inner diameter at the upper extremity thereof substantially equal to the outer diameter of the bead provided on the conventional disposable beverage container, as set forth hereinbefore. Such rim section 13 of the cover element 11 is curved downwardly and inwardly from the upper extremity thereof towards the lower extremity thereof; the inner diameter of such rim section 13 of cover element 11 at the lower extremity thereof being substantially equal to the outside diameter of such disposable beverage container beneath the bead provided thereon. The somewhat resilient material of which such cover element 11 is formed, as hereinbefore set forth, permits the rim section 13 thereof to be snapped down over such bead provided on such disposable beverage container; such cover element 11 thereby being firmly engaged with and effectively closing such disposable beverage container.

The cover element 11 further includes a recess, generally designated by the reference numberal 14, centrally formed in the exterior surface of the circular section 12 thereof. The depth of such recess 14 is substantially equal to the diameter of a foldable drinking straw positionable therein, as set forth hereinafter, and such recess 14 includes an elongated central segment 15; the length of such central segment 15 of recess 14 being on the order of several times the width thereof. Such recess 14 further includes a preferably arcuately, or semi-circularly, shaped segment 16 situated at each of the opposed ends of the elongated central segment 15 thereof; the radius of curvature of the arcuate side wall of each of such preferably arcuately shaped segments 16 of such recess 14 being equal to one-half of the width of the elongated central segment 15 thereof. The arcuate side wall of each of such preferably arcuately shaped segments 16 of such recess 14 is smoothly faired, at each of the ends thereof, into a side wall of such elongated central segment 15 of such recess 14.

The recess 14 provided in the cover element 11 further includes an arcuate area 17 constituting an enlargement thereof; such arcuate area 17 of the recess 14 bing centrally located along a portion of one of the sides of the elongated central segment 15 thereof. Such arcuate area 17 of such recess 14 is made sufficiently large to accomodate the introduction of a fingertip thereinto for the purpose set forth hereinafter. A small projecting portion, or projection, 18 is positioned adjacent each of the ends of such arcuate area 17 of such recess 14 on the adjacent side wall of such elongated central segment 15 thereof; such projecting portions 18 being disposed at about the plane of the exterior surface of the circular section 12 of such cover element 11 to project into such recess 14 over an appreciable portion of the depth thereof. A further projecting portion, or projection, 18 is also similarly positioned on the other side wall of such elongated central segment 15 of such recess 14 directly across from each of the projecting portions 18 located adjacent the ends of such arcuate area 17 of the recess 14 of cover element 11.

Such disposable cover element 11 for a disposable beverage container is further completely slit therethrough in a cruciform pattern at a desired location, as shown at 19 in FIGS. 1 and 4 of the drawing, for the purpose hereinafter set forth.

A foldable drinking straw, generally designated by the reference numeral 21, insertable into the recess 14 of such cover element 11, is shown in FIG. 3 of the drawing as it appears prior to the folding of the same for insertion into such recess 14. Such drinking straw 21 includes a straight central length 22, which is substantially equal to the length of the elongated central segment 15 of the recess 14 formed in such cover element 11, and which extends between two transversely corrugated lengths 23 of such drinking straw 21. The transversely corrugated lengths 23 of drinking straw 21, as shown in FIG. 3, are so proportioned that when the same are bent into half-loop configuration the radius of curvature of the outermost edge of each of the same is substantially equal to the radius of curvature of the arcuate wall of each of the preferably arcuately shaped segments 16 of such recess 14 of cover element 11, and the longitudinal midpoints of the two transversely corrugated lengths 23 of such drinking straw 21, as shown in FIG. 3, are spaced apart a distance substantially equal to one-half of the total length of the drinking straw 21, as shown in FIG. 3 of the drawing. The drinking straw 21 further includes straight terminal lengths 24, each of which is preferably substantially one-half of the length of the straight central length 22 thereof, but which may be unequal in length, if desired, provided that such unequal terminal lengths 24 of drinking straw 21 total substantially the same as the length of the straight central length 22 thereof.

The drinking straw 21, which in diameter is substantially equal to the depth of the recess 14 formed in the circular section 12 of cover element 11, is folded with the transversely corrugated lengths 23 thereof bent into half-loop configurations in coplanar relation, and such drinking straw 21 is then inserted into such recess 14, as shown in FIG. 4. The projecting portions, or projections, 18 somewhat overlie such drinking straw 21 when it has been so inserted into such recess 14 and secure such drinking straw 21 therein in a readily removable manner.

When a filled disposable container closed by the cover element 11 carrying such folded drinking straw 21, as hereinbefore set forth, has been handed over to a consumer, such consumer then may insert a fingertip into the arcuate area 17 of the recess 14 formed in the circular section 12 of such cover element 11 on one side of a straight length of such drinking straw 21, and a thumbtip into such elongated central segment 15 of such recess 14 on the other side of such straight length of such drinking straw 21, and readily remove the same from such recess 14. The drinking straw 21 is then straightened out to return the same to the shape shown in FIG. 3 of the drawing. If desired, such drinking straw 21 then further may be lengthened by drawing apart the terminal lengths 24 thereof to expand the transversely corrugated lengths 23 thereof; such drinking straw 21 when so lengthened appearing as shown in FIG. 5 of the drawing. An end of such drinking straw 21 may then be centrally pressed downwardly against the cruciform slit pattern provided at 19 in the circular section 12 of such cover element 11 to force the material extending along such slits downwardly and away from such drinking straw 21, allowing the same to move downwardly into such disposable beverage container for use.

It will now be clearly apparent that the use of a disposable cover element for a disposable beverage container carrying a folded drinking straw in a recess formed therein according to the present invention will effectively obviate certain of the problems encountered in the operation of a food and beverage establishment, as set forth hereinbefore.

Obviously, many modifications and variations of the instant invention are possible in the light of the foregoing teachings. The preferably arcuately shaped segments 16 of the recess 14 formed in the exterior surface of the circular section 12 of the cover element 11 could be otherwise shaped, as could be the arcuate area 17 of such recess 14. The walls of such recess 14, rather than being wholly vertically situated, as disclosed, could be rounded over the lower halves thereof, and the projecting portions 18 could be otherwise positioned around such recess 14. It is therefore to be understood that within the scope of the appended claims the invention may be practiced otherwise than as specifically described.

What is claimed as new and desired to be secured by Letters Patent of the United States is:

1. A disposable cover element for a disposable beverage container, comprising:

a section adapted to close the upper opening of said beverage container having a recess formed in the exterior surface thereof, said recess being adapted to receive a folded drinking straw having a straight central length extending between two transversely corrugated lengths each of which is bent into a halfloop configuration and further having at least one straight terminal length, said section of said cover element carrying a plurality of projecting portions extending into said recess over an appreciable portion of the depth thereof for readily removably securing said folded drinking straw in said recess.

2. The disposable cover element for a disposable beverage container according to claim 1, wherein the depth of said recess is substantially equal to the diameter of said folded drinking straw receivable therein.

3. The disposable cover element for a disposable beverage container according to claim 2, wherein said recess includes arcuately shaped segments adapted to receive said bent transversely corrugated lengths of said folded drinking straw and further includes an elongated central segment adapted to receive said straight lengths of said folded drinking straw.

4. The disposable cover element for a disposable beverage container according to claim 3, wherein said recess further includes an area constituting an enlargement thereof into which a fingertip may be inserted for facilitating the removal of said folded drinking straw from said recess.

5. The combination of a disposable cover element for a disposable beverage container and a folded drinking straw readily removably secured in a recess formed in said cover element, comprising:

a disposable cover element for a disposable beverage container including a section adapted to close the upper opening of said beverage container having a recess formed in the exterior surface thereof, said recess being adapted to receive therein a folded drinking straw substantially equal in diameter to the depth of said recess, said section of said cover element carrying a plurality of projecting portions extending into said recess over an appreciable portion of the depth thereof for readily removably securing said folded drinking straw in said recess; and, a folded drinking straw readily removably secured in said recess formed in said section of said cover element by said projecting portions, said folded drinking straw having a straight central length extending between two transversely corrugated lengths each of which is bent into a half-loop configuration in a coplanar relation, and further having at least one straight terminal length.

6. The combination according to claim 5, wherein said recess formed in said section of said cover element includes arcuately shaped segments adapted to receive said bent transversely corrugated lengths of said folded drinking straw and further includes an elongated central segment adapted to receive said straight lengths of said folded drinking straw.

7. The combination according to claim 6, wherein said recess formed in said section of said cover element includes an area constituting an enlargement thereof into which a fingertip may be inserted for facilitating the removal of said folded drinking straw from said recess.

* * * * *